US005190290A

United States Patent [19]

Take

[11] Patent Number: 5,190,290

[45] Date of Patent: Mar. 2, 1993

[54] HEAD FOR GOLF CLUB

[75] Inventor: Shigeki Take, Tokyo, Japan

[73] Assignee: Daiwa Golf Co., Ltd., Tokyo, Japan

[21] Appl. No.: 788,927

[22] Filed: Nov. 7, 1991

[30] Foreign Application Priority Data

Nov. 13, 1990 [JP] Japan ..... 2-118675[U]

[51] Int. Cl.[5] ..... A63B 53/04

[52] U.S. Cl. ..... 273/169; 273/171; 273/173; 273/DIG. 23

[58] Field of Search ..... 273/167-175, 273/77 R, 77 A, 78, DIG. 23

[56] References Cited

U.S. PATENT DOCUMENTS

| | | | |
|---|---|---|---|
| 1,574,213 | 2/1926 | Tyler | 273/174 X |
| 4,121,832 | 10/1978 | Ebbing | 273/173 X |
| 4,199,144 | 4/1980 | Skelly | 273/173 X |
| 4,252,262 | 2/1981 | Igarashi | 273/173 X |
| 4,630,827 | 12/1986 | Yoneyoma | 273/173 X |
| 4,655,459 | 4/1987 | Antonious | 273/171 |
| 4,690,408 | 9/1987 | Kobayashi | 273/174 X |
| 4,697,814 | 10/1987 | Yamada | 273/169 |
| 4,728,105 | 3/1988 | Kobayashi | 273/169 |
| 4,793,616 | 12/1988 | Fernandez | 273/167 H |
| 4,803,023 | 2/1989 | Enomoto et al. | 273/171 X |
| 4,874,171 | 10/1989 | Ezaki et al. | 273/167 H X |
| 4,883,275 | 11/1989 | Boone | 273/174 X |
| 5,078,398 | 1/1992 | Reed et al. | 273/173 X |

FOREIGN PATENT DOCUMENTS

| | | | |
|---|---|---|---|
| 61-154968 | 9/1986 | Japan . | |
| 63-5767 | 1/1988 | Japan . | |
| 1473891 | 5/1977 | United Kingdom | 273/173 |
| 2185891 | 8/1987 | United Kingdom | 273/173 |

*Primary Examiner*—V. Millin
*Assistant Examiner*—Sebastiano Passaniti
*Attorney, Agent, or Firm*—Longacre & White

[57] ABSTRACT

A head for a gold club, comprises: a metal body including a hosel and a sole which are formed integrally with each other; a filling member provided on the sole; and a fiber-reinforced resin coating the metal body and the filling member except the sole, wherein the metal body is integrally formed with a support portion extending from the ankle part of the metal body toward the toe part thereof and supporting the filling member at a rear thereof.

9 Claims, 6 Drawing Sheets

HEAD FOR GOLF CLUB

BACKGROUND OF THE INVENTION

The present invention relates to a golf club, more particularly to a head for a golf club called an iron.

To replace a conventional golf club head made of a metal core and a fiber-reinforced resin coating the core, a golf club head whose hosel and sole are integrally formed of a metal and which has a filling member made of a synthetic resin and disposed on the sole and has a fiber-reinforced resin coating the hosel and the filling member has recently been proposed as a head which can be designed to have its center of gravity low enough to be properly handled by a beginner golfer or an unpowerful golfer and are softer in the feeling of hitting of a golf ball and better in the length and direction of hitting-away of the ball than the conventional head, as disclosed in Japanese Utility Model Applications (OPI) No. 154968/86 and Japanese Patent Application (OPI) No. 5767/88 (the term "OPI" as used herein means an "unexamined published application").

In such a head disclosed in the Japanese Utility Model Application (OPI) No. 154968/86, a hosel and a sole are integrally formed of a metal such as soft iron and stainless steel, and a filling member is made of a fiber-reinforced resin and a heavy material mixed therewith and has a nearly triangular cross section. The filling member is integrally coated with a fiber-reinforced resin layer whose cross section is shaped nearly as inverted V and whose lower portion has a flat front surface nearly flush with that of the upper portion of the sole.

In such a head disclosed in the Japan Utility Model Application (OPI) No. 5767/88, a sole made of a metal, a core made of a light synthetic resin of 0.6 or less in specific gravity, and a body which is made of a synthetic resin and reinforcing fibers mixed therewith and coats the core are integrally formed together.

In each of the heads disclosed in these Applications, the filling member is supported at the bottom thereof by a projection extending slightly up from the sole, and entirely differs in material from the sole. For that reason, it is likely that the filling member is tilted rearward and separates from the sole at the time of hitting of a golf ball with the head, namely, the head is damaged at that time. This is a problem. If the projection were made taller to more securely support the filling member, the center of gravity of the head would be elevated to make it difficult to properly handle the golf club. This is also a problem.

SUMMARY OF THE INVENTION

The present invention was made in order to solve the problems mentioned above. Accordingly, it is an object of the invention to provide a head which is for a golf club and which not only includes a filling member made of a synthetic resin and disposed in the head to create advantages but is strong enough to withstand the impact of hitting of a golf ball with the head.

The head comprises a metal body including a hosel and a sole which are formed integrally with each other; the filling member provided on the sole; and a fiber-reinforced resin coating the metal body and the filling member except the sole. The head is characterized in that the metal body is integrally formed with a support portion extending from the ankle part of the body toward the toe part thereof and supporting the filling member at the rear thereof. The filling member is thus supported by the support portion against the stress of the head at the time of the hitting of the golf ball with the head so securely that the filling member is prevented from being tilted rearward and separating from the sole or the fiber-reinforced resin due to the impact of the hitting, namely, the head is prevented from being damaged at that time.

DETAILED DESCRIPTION OF EXEMPLARY EMBODIMENTS

Embodiments of the present invention are hereafter described in detail with reference to the drawings attached hereto.

Figure 1:
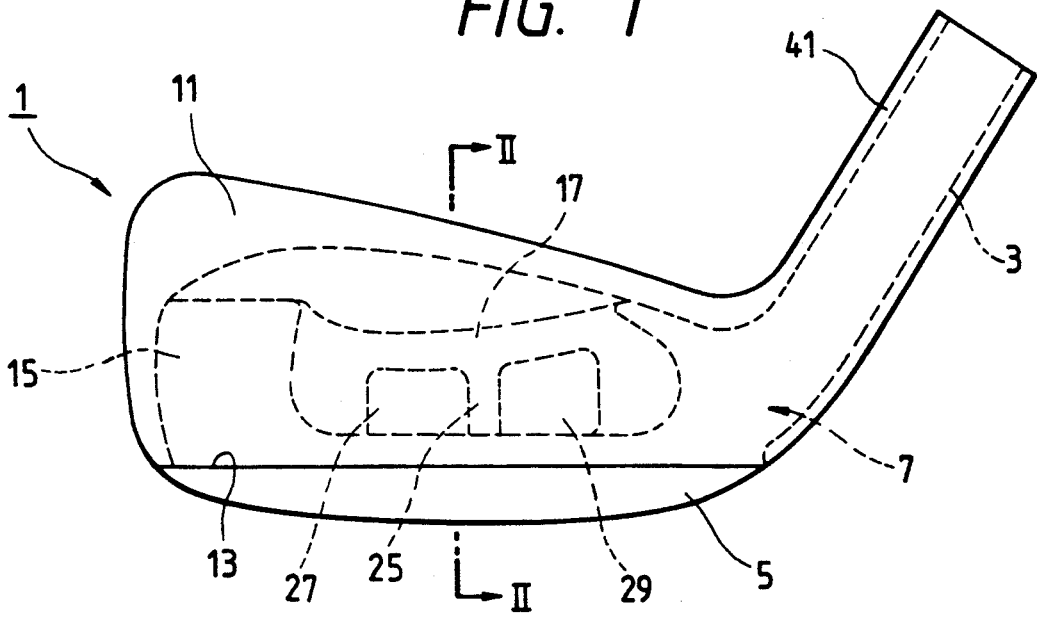
FIG. 1 is a front view of a head which is for a golf club and is an embodiment of the present invention.
Figure 2:
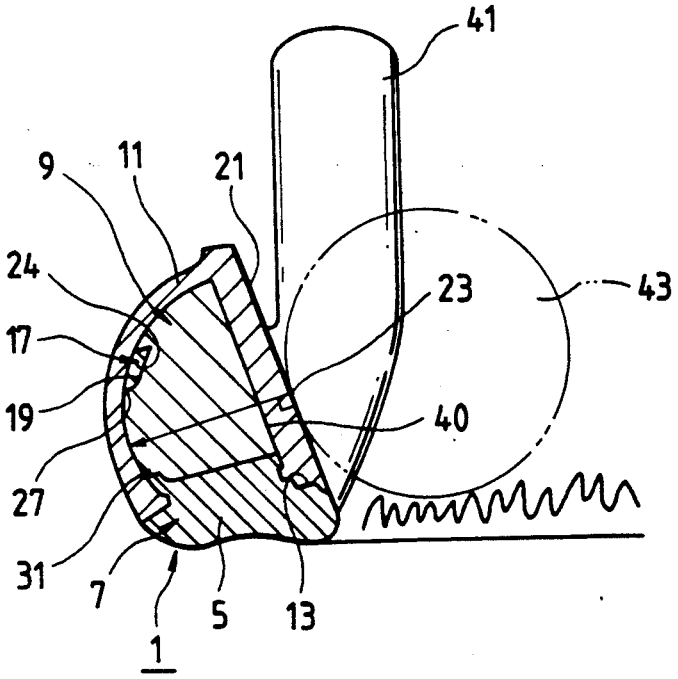
FIG. 2 is a sectional view of the head along lines II shown in FIG. 1.

FIGS. 1, 2, 3 and 4 show a head which is for a golf club and is one of the embodiments. Shown at 1 in FIGS. 1 and 2 is the head which has a front contour similar to that of a conventional head. The head 1 comprises a metal body 7 including a hosel 3 and a sole 5 which are formed integrally with each other, a filling member 9 made of a synthetic resin and disposed in the metal body, and a fiber-reinforced resin 11 coating the body except the sole. The head 1 is conjoined at the hosel 3 to the shaft of the golf club.

Figure 3:
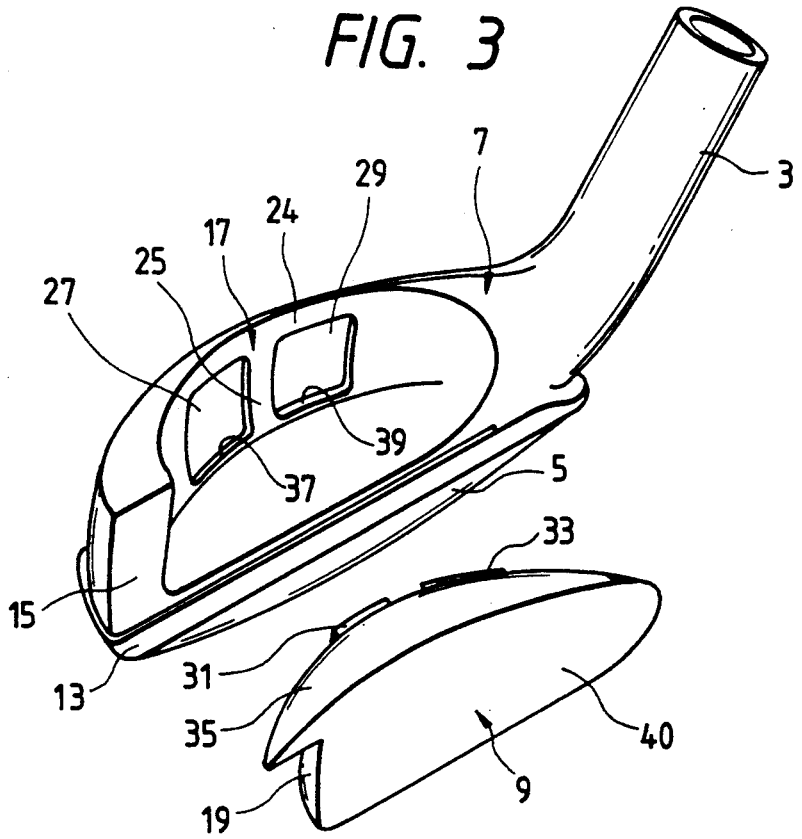
FIGS. 3 and 4 are perspective exploded views of the head; $
Figure 4:
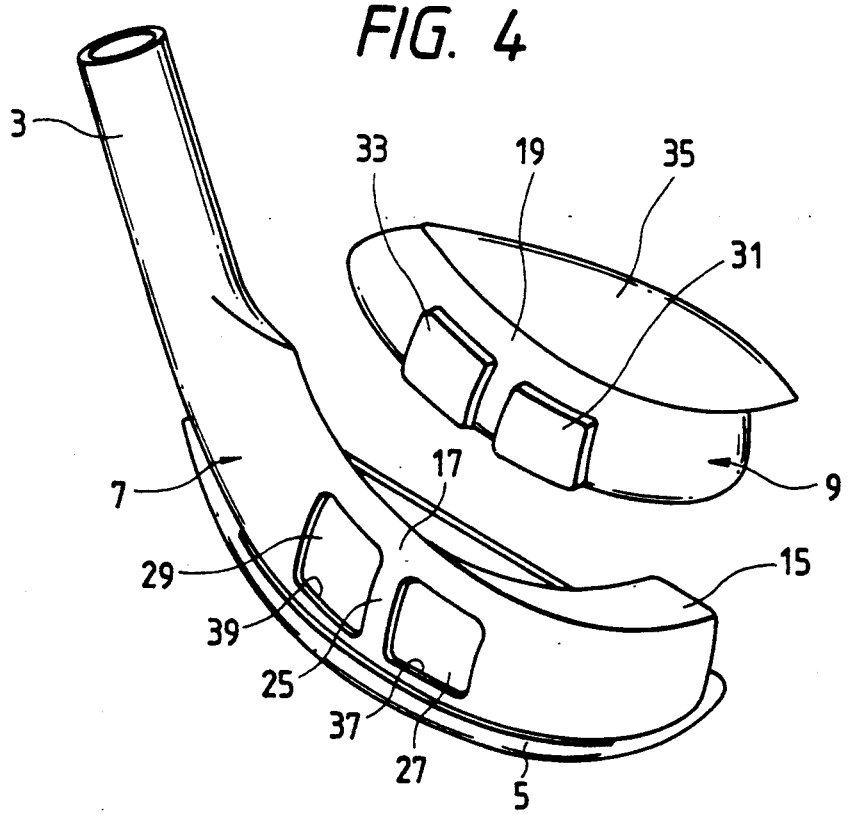

The metal body 7 is a made of a metal such as stainless steel, soft iron and brass, and has a step portion 13 at the front of the sole 5, a jut weight 15 for heightening the speed of the head 1, and a support portion 17 extending as a bridge from the jut weight to the ankle part of the body along the form of the rear of the head and supporting the filling member 9 in contact with the rear 19 thereof above the point of the intersection of the rear of the member and the production of the perpendicular to the face 21 of the head at the sweet spot 23 thereof, as shown in FIG. 2, to prevent the filling member from being tilted rearward due to the impact of the hitting of a golf ball 43 with the head. The support surface 24 of the support portion 17 faces toward the sweet spot 23 so as to effectively support the filling member 9 against the stress of the head 1 at the time of the hitting of the golf ball with the head. The intermediate part of the support portion 17 is coupled to the sole 5 by a strut 25 in such a manner that two substantially rectangular openings 27 and 29 are defined among them, as shown in FIGS. 3 and 4. Projections 31 and 33 provided on the rear 19 of the filling member 19 are fitted in the openings 27 and 29, respectively.

The filling member 9 is disposed on the sole 5 of the metal body 7, as shown in FIG. 2, and is made of a synthetic resin such as nylon, polypropylene, ABS resin, polyethylene terephthalate and hard polyvinyl chloride or of a mixture of the resin and fiberglass, glass grains, carbon fibers, a metal powder or the like so as to be about 0.4 to 1.4 in specific gravity. The rear 19 of the filling member 9 is curved to extend in contact with the support portion 17 formed as a rear part of the head 1, and has the projections 31 and 33 fitted in the openings 27 and 29, and an engagement portion 35 located over the projections 31 and 33 and shaped along the form of the rear of the head 1 as well as the jut weight 15 and the support portion 17. The engagement portion 35 is engaged with the tops of the jut weight 15 and the support portion 17, and the projections 31 and 33 are fitted in the openings 27 and 29, in such a manner that the filling member 9 is supported by support projections 37 and 39 formed on the sole 5 and extending slightly up into the bottom portions of the openings, and is attached to the metal body 7. The front 40 of the filling member 9 is a flat surface.

The fiber-reinforced resin 11 is a carbon-fiber-reinforced resin, a fiberglass-reinforced resin or the like, and may be mixed with an additive such as whisker. The resin 11 is molded on the metal body 7 and the filling member 9 in dies by a compression molding machine so that the lower part of the front portion of the molded resin has a flat front surface nearly flush with that of the step portion 13 of the sole 5, and the resin coats the metal body and the filling member except the sole, and has a tubular portion 41 extending up from the heel of the sole and coating the hosel 3, as shown in FIGS. 1 and 2. The face 21 of the resin 11 has a plurality of horizontal grooves for spinning the golf ball 43 when it is hit with the head 1.

The hitting of the golf ball 43 with the head 1 attached to the shaft of the golf club feels soft. The head 1 carried the ball 43 well at the time of the hitting. In other words, it takes a relatively long time for the ball 43 to go off the head 1 at the time of the hitting of the ball. For that reason, the ball 43 can be hit away from the head 1 in an aimed direction. Besides, the support portion 17 facing toward the sweet spot 23 of the head 1 securely support the filling member 9 in contact with the rear 19 thereof against the stress of the head at the time of the hitting of the ball 43 with the head 1 to prevent the member from being tilted rearward due to the impact of the hitting of the ball and separating from the sole 5 or the fiber-reinforced resin 11. Thus, the filling member 9 made of the synthetic resin is not only disposed in the head 1 to produce the advantages that the hitting of the ball 43 with the head feels soft and good and the ball can be hit away from the head in the aimed direction, but also the support portion 17 supports the filling member to produce the advantage that the filling member is prevented from separating from the sole 5 or the coating resin 11 due to the impact of the hitting of the ball or the head is prevented from being damaged due to the impact. Moreover, the openings 27 and 29 are provided between the sole 5 and the support portion 17 to produce the advantages that the weight of the head 1 is reduced, the center of gravity of the head is lowered, and it is easy to position the filling member 9 on the sole 5 in manufacturing the head. Therefore, the head 1 has the more advantages than that disclosed in the Japan Utility Model Application (OPI) No. 154968/86.

FIGS. 5, 6, 7 and 8 show a head 45 which is for a golf club and is another of the embodiments. The major difference of the head 45 from the preceding one 1 is that the head 45 does not have a jut weight, but has a support portion 47 extending from the ankle part of a metal body 57 to the toe part thereof and supporting a filling member 51 in contact with the rear 53 thereof at the higher portion of the rear than the support portion 17 of the preceding head does. The head 45 comprises the metal body 57 including a hosel 55 and a sole 49 which are formed integrally with each other, the filling member 51 made of a synthetic resin, and a fiber-reinforced resin 59 coating the metal body and the filling member except the sole. The head 45 is conjoined at the hosel 55 to the shaft of the golf club.

Figure 6:
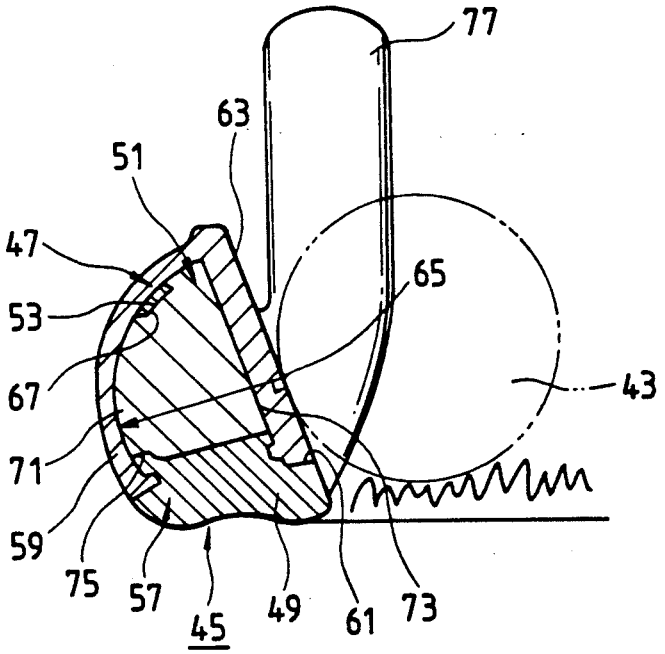
FIG. 6 is a sectional view of the head along lines VI shown in FIG. 5.

The metal body 57 is made of the same material as that 7 of the preceding heat 1. The sole 49 has a step portion 61 at the front of the sole. The body 57 has the support portion 47 integrated with the sole 49 and slowly curved to extend as a bridge from the ankle part of the body to the toe part thereof along the form of the rear of the head and support the filling member 51 in contact with the rear 53 thereof to prevent the member from being tilted rearward due to the impact of the hitting of a golf ball 43 with the head. The support portion 47 supports the filling member above the point of the intersection of the rear 53 thereof and the production of the perpendicular to the face 63 of the head 45 at the sweet spot 65 thereof, as shown in FIG. 6. The support surface 67 of the support portion 47 faces toward the sweet spot 65 to effectively support the filling member 51 against the stress of the head 45 at the time of the hitting of the golf ball 43 with the head 45. A projection 71 provided on the rear 53 of the filling member 51 is fitted in an opening 69 defined between the support portion 47 and the sole 49.

Figure 7:
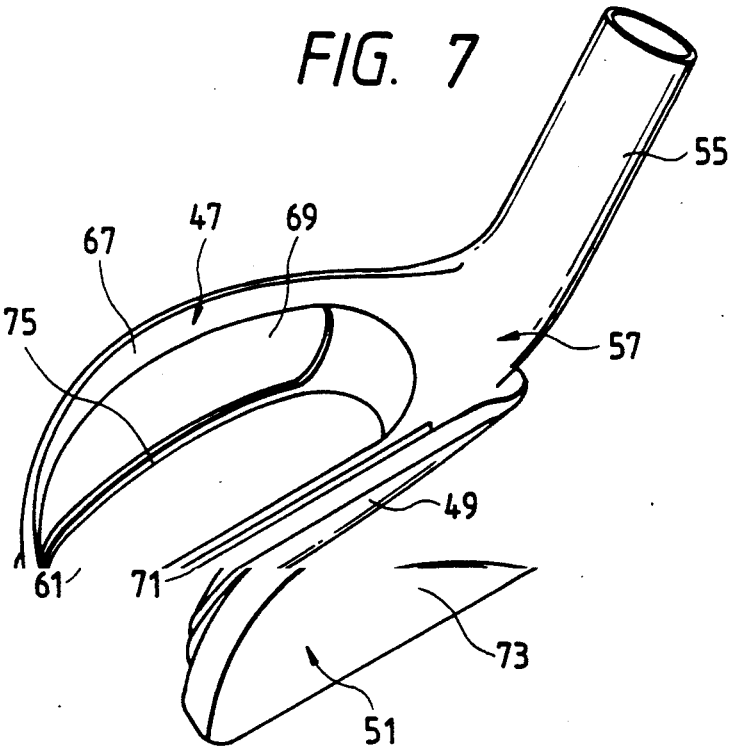
FIGS. 7 and 8 are perspective exploded views of the head shown in FIG. 5.
Figure 8:
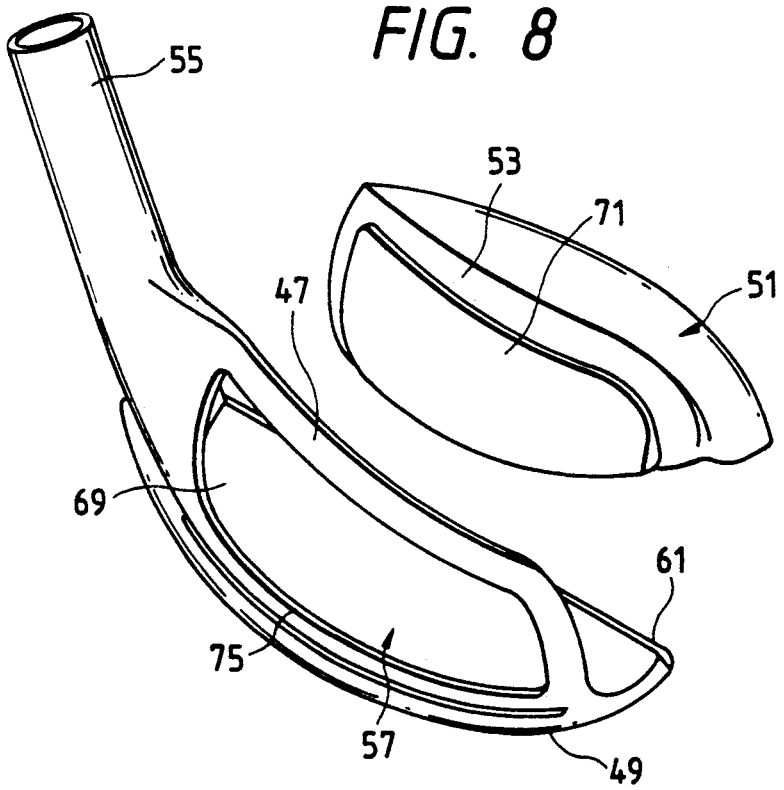

The filling member 51 is disposed on the sole 49, as shown in FIG. 6. To restore a head speed lost because of not having a jut weight such as that of the preceding head 1, the filling member 51 is set at a specific gravity of about 5.0 by mixing the member with a larger quantity of a metal powder or the like than the filling member 9 of the preceding head or by the like. The rear 53 of the filling member 51 is curved to extend in contact with the support portion 47, and has the projection 71 fitted in the opening 69. The front 73 of the filling member 51 is shaped as a flat surface as shown in FIG. 7. The projection 71 is fitted in the opening 69 and a support projection 75 extending slightly up from the sole 49 into the bottom portion of the opening supports the filling member 51, so that the filling member is attached to the metal body 57.

Figure 5:
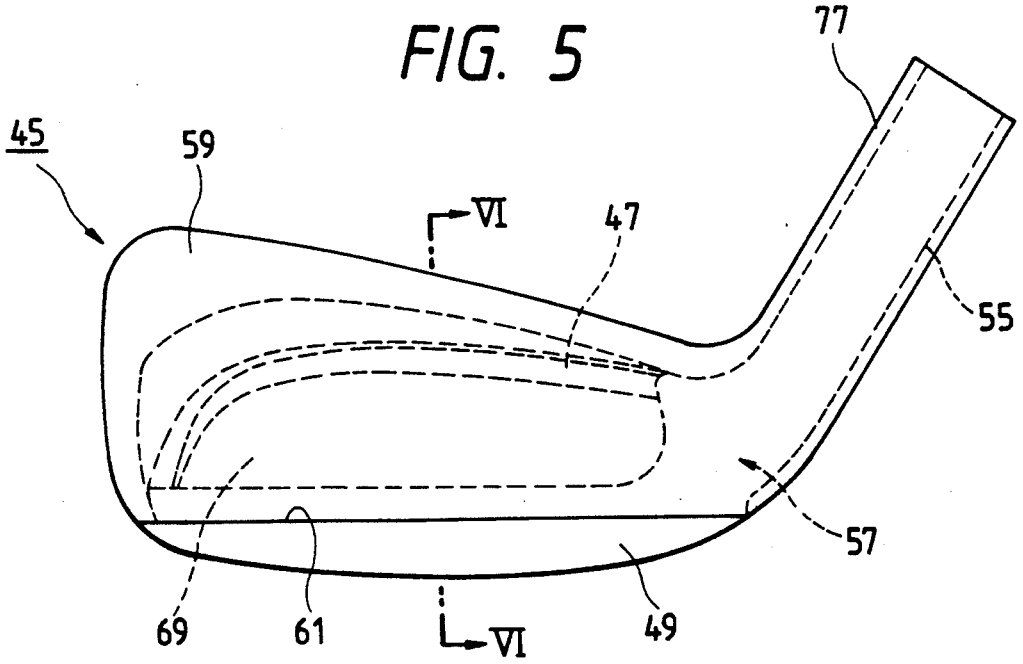
FIG. 5 is a front view of a head which is for a golf club and is another embodiment of the invention.

The fiber-reinforced resin 59 coating the filling member 51 and the metal body 57 except the sole 49 is a carbon-fiber-reinforced resin, a fiberglass-reinforced resin or the like, and may be mixed with an additive such as whisker. The resin 59 is molded on the filling member 51 and the metal body 57 in dies by a compression molding machine so that the lower part of the front portion of the molded resin has a flat front surface nearly flush with that of the step portion 61 of the sole 49, and the resin has a tubular portion 77 extending up from the heel of the sole and coating the hosel 55, as shown in FIGS. 5 and 6. The face 63 of the head 45 has a plurality of horizontal grooves for spinning the golf ball 43 when it is hit with the head.

The hitting of the golf ball 43 with the head 45 attached to the shaft of the golf club feels softer than that with a head made of a core and a fiber-reinforced resin coating the core. It takes more time for the ball 43 to go off the head 45 at the time of the hitting of the ball than to go off the other head made of the core and the resin. For that reason, it is more possible to hit the ball 43 away from the head 45 in an aimed direction than to hit the ball away from the other head in the aimed direction. Besides, the support portion 47 having the support surface 67 facing toward the sweet spot 65 of the head 45 securely supports the filling member 51 in contact with the rear 53 thereof against the stress of the head at the time of the hitting of the ball 43 therewith to prevent the filling member from being tilted rearward and separating from the sole 49 or the coating resin 59 at that time. Moreover, since the support portion 47 supports the filling member 51 on the rear 53 thereof at the higher part thereof than the support portion 17 of the preceding head 1 does, the filling member is more securely supported even if the ball 43 is hit with the head 45 off the sweet spot 65 thereof. Thus, the filling member 51 made of the synthetic resin is not only disposed in the head 45 to produce the advantages that the hitting of the ball 43 with the head feels soft and good and the ball can be hit away from the head in the aimed direction, but also the support portion 47 supports the filling member to securely prevent it from separating from the sole 49 or the coating resin 59 due to the impact of the hitting of the ball 43 with the head, even if the ball is hit with the head off the sweet spot 65 thereof. Furthermore, since the opening 69 is provided between the support portion 47 and the sole 49, the weight of the head 45 is reduced, the center of gravity thereof is lowered and it is easy to position the filling member 51 on the sole 49 in manufacturing the head. Therefore, the head 45 has the same advantages as the preceding head 1.

Figure 9:
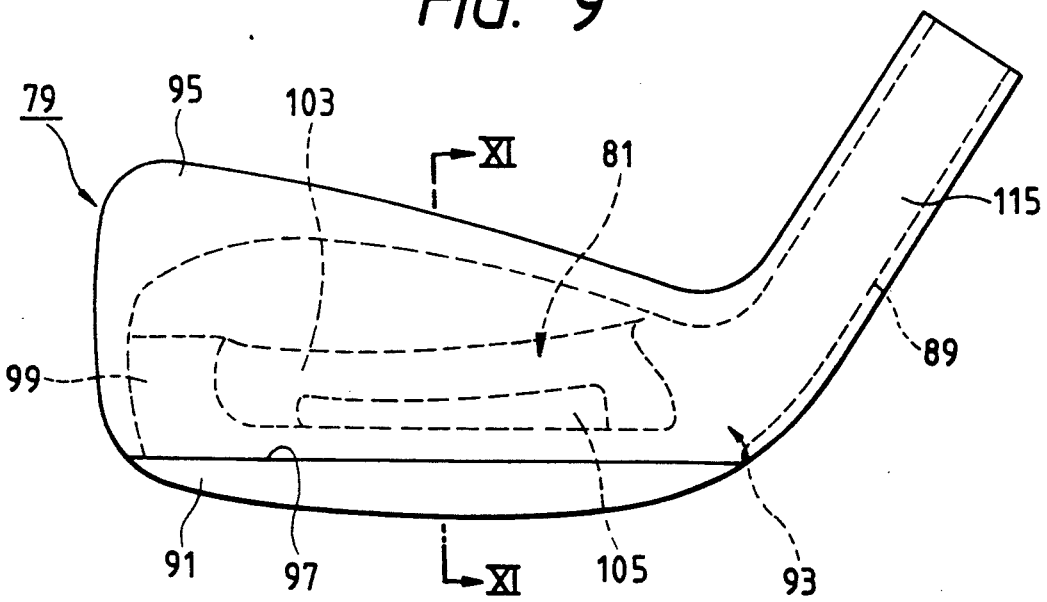
FIG. 9 is a front view of a head which is for a golf club and is yet another embodiment of the invention.
Figure 11:
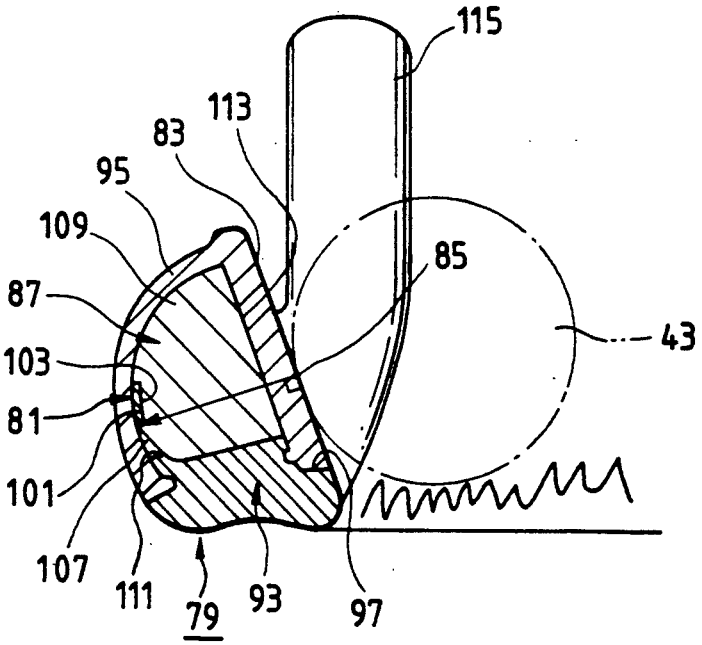
FIG. 11 is a sectional view of the head along lines XI shown in FIG. 9.
Figure 10:
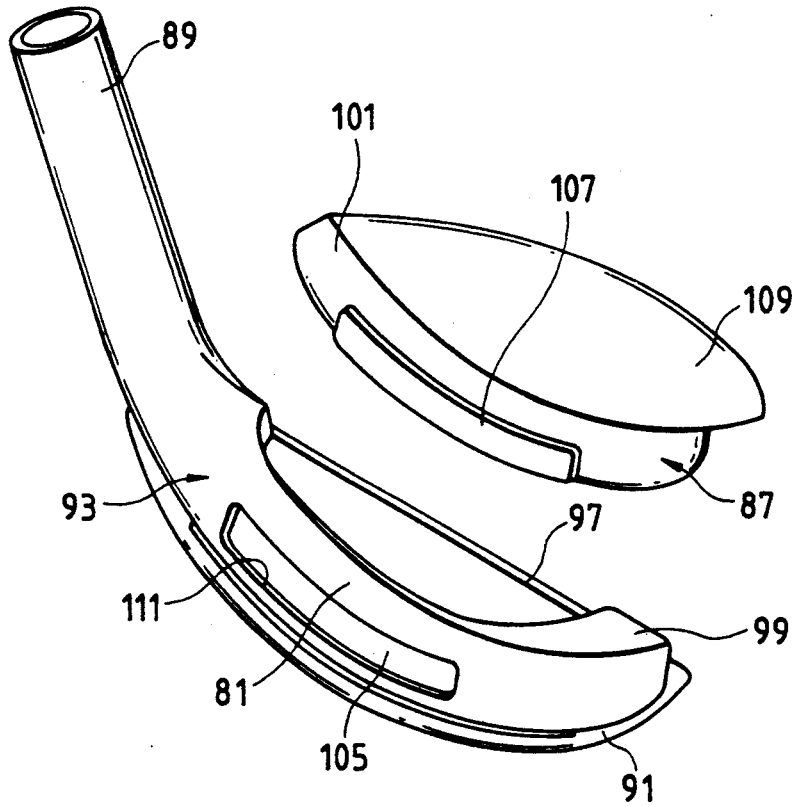
FIG. 10 is a perspective exploded view of the head shown in FIG. 9.

FIGS. 9, 10 and 11 show a head 79 which is for a golf club and is yet another of the embodiments. The major difference of the head 79 from the most preceding one 1 is that the bottom of a support portion 81 is located at the same height as the point of the intersection of the rear 101 of a filling member 87 and the production of the perpendicular to the face 83 of the head at the sweet spot 85 thereof, as shown in FIG. 11. The head 79 comprises a metal body 93 including a hosel 89 and a sole 91 which are formed integrally with each other, the filling member 87 made of a synthetic resin, and a fiber-reinforced resin 95 coating the filling member and the metal body except the sole. The head 79 is conjoined at the hosel 89 to the shaft of the golf club.

The metal body 93 is made of the same metal as the metal body 7 of the head 1, and has a step portion 97 at the front of the sole 91, a jut weight 99 provided on the sole 91 at the toe thereof and smaller in height than that 15 of the head 1, and the support portion 81 extending as a bridge from the jut weight to the ankle part of the metal body along the form of the rear of the head 79 so as to support the filling member 87 in contact with the rear 101 thereof to prevent the filling member from being tilted rearward due to the impact of the hitting of a golf ball 43 with the head. The support surface 103 of the support portion 81 faces toward the sweet spot 85 of the head 79 to effectively support the filling member 87 against the stress of the head at the time of the hitting of the ball 43 with the head. A projection 107 provided on the rear 101 of the filling member 87 is fitted in an opening 105 defined between the support portion 81 and the sole 91.

The filling member 87 is made of the same material as that 9 of the head, and has nearly the same form as the member 9. The rear 101 of the filling member 87 is curved to extend in contact with the support portion 81, and has the projection 107 fitted in the opening 105. The filling member 87 has an engagement portion 109 shaped along the form of the rear of the head 79. The filling member is fitted at the engagement portion 109 thereof on the support portion 81 and the jut weight 99 and at the projection 107 of the member in the opening 105 and supported by a support projection 111 extending slightly up from the sole 91 into the bottom portion of the opening, so that the filling member is attached to the metal body 93. The front 113 of the filling member 87 is a flat surface.

The fiber-reinforced resin 95 coating the filling member 87 and the metal body 93 except the sole 91 is a carbon-fiber-reinforced resin, a fiberglass-reinforced resin or the like, and may be mixed with an additive such as whisker. The resin 95 is molded on the filling member 87 and the metal body 93 in dies by a compression molding machine so that the lower part of the front portion of the molded resin has a flat front surface nearly flush with that of the step portion 95 of the sole 91, and the resin has a tubular portion 115 extending up from the heel of the metal body and coating the hosel 89. The faces 83 of the head 79 has a plurality of horizontal grooves for spinning the golf ball 43 when it is hit with the head.

The hitting of the golf ball 43 with the head 79 attached to the shaft of the golf club feels soft. It takes a relatively long time for the ball 43 to go off the head 79 when it is hit with the head. For that reason, the ball 43 can be hit away from the head 79 in an aimed direction. Besides, the support portion 81 securely supports the filling member 87 in such a position as to withstand the stress of the head 79 at the time of the hitting of the ball 43 with the head to prevent the filling member from being tilted rearward and separating from the sole 91 or the fiber-reinforced resin 95 due to the impact of the hitting. Therefore, the head 79 has the same advantages as the most preceding head 1.

The present invention is not confined to the above-described embodiments, but may be embodied or practiced in other various ways without departing from the scope or spirit of the invention.

What is claimed is:

1. A head for a golf club, comprising:

a metal body including a hosel and a sole which are formed integrally with each other, said sole having a proximate end and a distal end with respect to said hosel;

a filling member provided on said sole, said filling member having a front surface and a rear surface opposite said front surface and an upper and lower extent; and a fiber-reinforced resin coating a portion of said metal body and said filling member, wherein said metal body is integrally formed with a support portion and wherein an opening is defined between said sole and said support portion generally above said lower extent for supporting said filling member along said rear surface, said support portion extending from said hosel toward said distal end of said sole being shaped to extend along a portion of said rear surface generally above said sole.

2. A head according to claim 1, wherein the head includes a face having a sweet spot, and said support portion supports said filling member at a point of an intersection of the rear surface and a perpendicular to the face at the sweet spot thereof.

3. A head according to claim 1, wherein the head includes a face having a sweet spot, and said support portion supports said filling member above a point of an intersection of the rear surface and a perpendicular to the face at the sweet spot thereof.

4. A head according to claim 1, wherein said support portion is coupled to said sole by a strut.

5. A head according to claim 1, wherein said support portion has a support surface supporting said filling member and shaped to face toward a sweet spot of the head.

6. A head according to claim 1, wherein a projection provided on said filling member is fitted in an opening.

7. A head according to claim 1, wherein a jut weight for heightening the speed of said head is provided at the distal end of said sole; and said support portion is formed integrally with said hosel of said metal body and said weight, and extends from said hosel to said jut weight.

8. A head according to claim 1, wherein said filling member is made of a synthetic resin.

9. A head according to claim 1, wherein said filling member is made of a synthetic resin and a reinforcing material mixed therewith.

* * * * *